United States Patent [19]

Pittman et al.

[11] Patent Number: 4,513,756

[45] Date of Patent: Apr. 30, 1985

[54] PROCESS OF MAKING TOBACCO PELLETS

[75] Inventors: Luther B. Pittman; Jennings M. Agner; George F. Hunt, all of Owensboro, Ky.

[73] Assignee: The Pinkerton Tobacco Company, Owensboro, Ky.

[21] Appl. No.: 489,389

[22] Filed: Apr. 28, 1983

[51] Int. Cl.[3] ..... A24B 3/00

[52] U.S. Cl. ..... 131/111; 131/119; 131/77; 131/78; 131/79

[58] Field of Search ..... 131/111, 119, 77, 78, 131/79

[56] References Cited

U.S. PATENT DOCUMENTS 2,158,928 5/1939 Deich ..... 131/111

FOREIGN PATENT DOCUMENTS 44055 5/1927 Norway ..... 131/119

*Primary Examiner*—V. Millin

*Attorney, Agent, or Firm*—Kenyon & Kenyon

[57] ABSTRACT

A blend of dark-fired and one-sucker tobacco and a cased cigar type tobacco are cut to obtain a shredded product. After the addition of water and a binder, the resultant mixture is heated, dried and then pelletized into individual discrete pellets. Various additives can be added prior to or during pelletizing. The pellets are sized to give the user the desired taste and flavor of a conventional smokeless tobacco.

11 Claims, 3 Drawing Figures

Fig. 1.
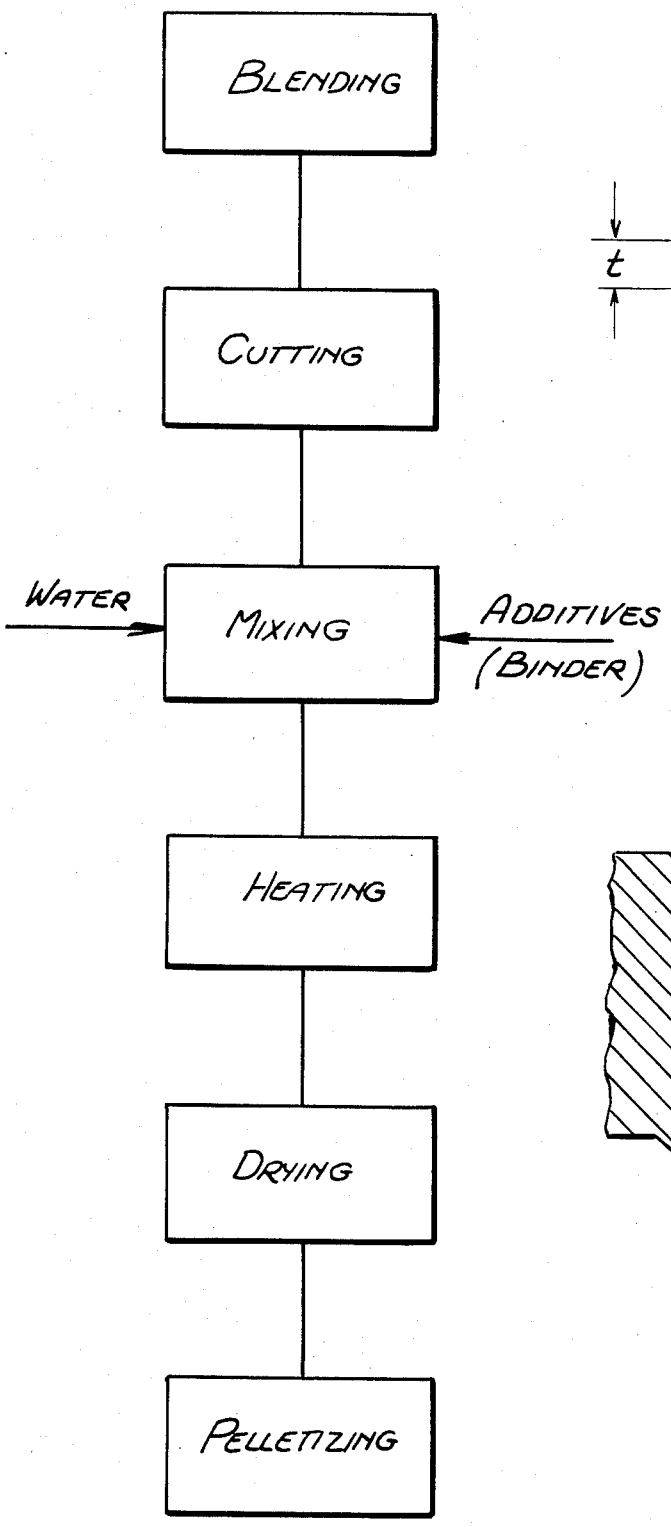
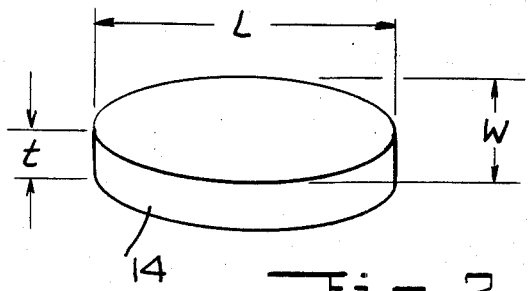
Fig. 2.
Fig. 3.
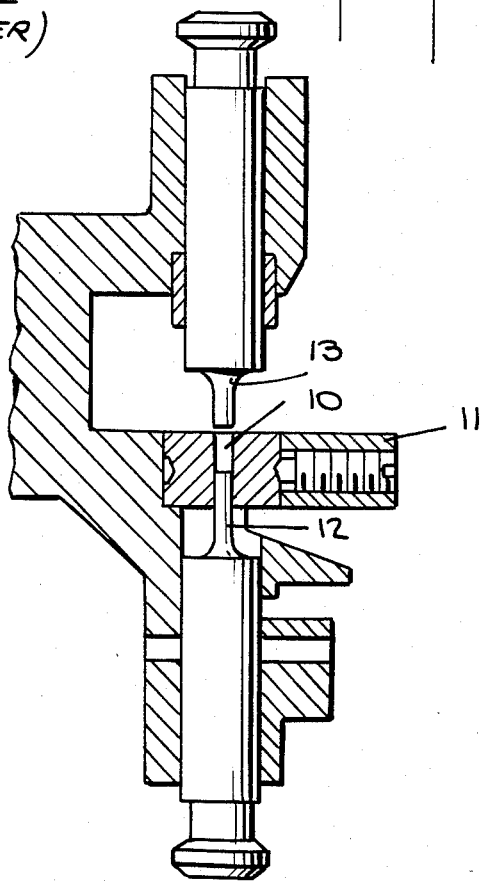

PROCESS OF MAKING TOBACCO PELLETS

This invention relates to a process of making tobacco pellets and particularly smokeless tobacco pellets.

Heretofore, various techniques have been known for fabricating tobacco into shapes and sizes suitable for chewing or placement in the mouth. For chewing purposes, the tobacco has been fabricated in plugs from which bite-size pieces can be taken or as pellets.

Where the chewing tobacco has been formed into plugs, the known processes have generally treated a plurality of superimposed filler leaves with a suitable binder and compressed the leaves into a rectangular bar. In some cases, the bar has been covered with a wrapper leaf and further compressed into a relatively dense bar varying from substantially one inch to one quarter of an inch in thickness. The portions desired for use are then removed by biting or cutting. In order to improve on such a bar, it has been known to fabricate the bar with grooves so that individual pieces of the plug can be broken off manually for chewing purposes.

In the case of the pellets, such have sometimes been made of clyindrical shape. In such cases, the tobacco used for the pellets, or at least the wrapper, has required rolling in order to achieve the final shape. In other cases, a finely ground or granulated tobacco, such as dry snuff, has been used in the manufacture of pellets.

It is object of this invention to provide a relatively simple process of making shredded tobacco into pellet form.

It is another object of the invention to provide oral tobacco pellets of conveinent size.

It is another object of the invention to provide an oral tobacco pellet which can be readily handled and packaged.

It is another object of the invention to provide smokeless tobacco pellets in an attractive shape.

Briefly, the invention provides a process of making oral tobacco pellets wherein a blend of dark-fired and one sucker tobacco is further blended with a cased cigar type tobacco. Thereafter, the blend is cut to obtain a product which is sized to pass through a No. 20 Tyler screen. After cutting, at least a binder is added to the shredded product along with water in order to obtain a uniform mixture of the tobacco, binder and water. Next, the mixture is heated to a temperature sufficient to uniformly disperse the binder through the mixture.

The mixture is then dried, for example at room temperature, to a moisture content of from eight percent to ten percent water by weight. Next, the dried mixture is pelletized into individual discrete pellets having a weight of from 420 to 450 milligrams, for example in a tablet press.

A flavorant may also be added to the shredded tobacco pellets prior to pelletizing. The flavorant may also be added with the binder prior to the heating step or may be added after pelletizing.

For pelletizing, depending on the working of the mixture, it has been found that the moisture content can be between eight percent and ten percent by weight.

These and other objects and advantages of the invention will become more apparent from the following detailed description taken in conjunction with the accompanying drawings, wherein:

FIG. 1 schematically illustrates a flow diagram of a process in acccordance with the invention;

FIG. 2 illustrates a tobacco pellet made in accordance with the invention; and

FIG. 3 illustrates a fragmentary view of a tablet press for pelletizing a tobacco mixture in accordance with the invention.

Referring to FIG. 1, in accordance with the process of making smokeless tobacco pellets, a blend of, for example, 90% dark-fired tobacco and 10% one sucker tobacco which has been completely fermented is blended with a cased cigar type tobacco, for example, in a ratio of 75% dark-fired and one sucker and 25% cased cigar type tobacco. After blending, the tobacco is double cut on cigarette tobacco-type cutters to obtain a shredded product. To this end, the first cut is made so as to obtain from 30 to 90 cuts per inch with 60 cuts being preferred. The second cut provides the shredded product.

After cutting, the tobacco is screened, for example on a No. 20 Tyler screen with the material passing through the screen being used for the shredded product and the material retained on the screen being returned to the second cutter for further cutting. Of note, the screening of the cut product insures uniformity of the product.

Normally, the tobacco which is used in the blending step has a moisture content of about 16% by weight. Accordingly, the moisture content is raised to the range of from 18% to 20% in order to improve the cutting of the tobacco.

After cutting and screening, various additives may be added to the shredded product. For example, ordinary table salt may be added as a preservative and to add taste. In addition, since tobacco generally has a pH in the range of from 5 to 5.5 percent, potassium carbonate or sodium carbonate or the like is added in an amount sufficient to raise the pH to 7.0.

In addition, licorice or other suitable binder is added, for example in powdered form, in an amount sufficient to act as a binder. Other binders may also be added in small amounts, for example use may be made of gum talah. Finally, sufficient water is added in order to dissolve any powdered additives and to obtain a uniform mixture of the tobacco, additives and water.

Thereafter, the mixture is heated and stirred in a drum kettle at a temperature of 140° F. in order to obtain a uniform dispersal of the binder and the other additives through the mixture. During this time, the powdered additives are dissolved. For example, where the licorice has been added in powdered form, the licorice is now changed into a liquid form. Suitable defoaming agents, such as a dimethyl polysiloxane, may also be added during this time, e.g., in an amount of 0.3 percent by weight.

Thereafter, the mixture is cooled while being transported via a conveyor to a rotary drier and dried at room temperature to a moisture content of from eight percent to ten percent water by weight. At this time, the dried mixture can be packaged for storage purposes or for shipment to another location for further processing. By way of example, each 100 pounds of product which is obtained at this point in the process has the following general composition:

| Product | Percentage |
|---|---|
| Tobacco (16–17% moisture content) | 75–85% |
| Salt | 1–4% |
| Potassium Carbonate ($KCO_3$) | 1–4% |
| Licorice | 1–4% |

-continued

| Product | Percentage |
|---|---|
| Gum Talah | 0.1–0.05% |
| Water | Remainder |

The above percentages are given on a dry basis and the water content is between 10 and 20 pounds.

The resulting product is then pelletized into individual discrete pellets using any suitable equipment such as a tablet press. In this regard, the tablet press is operated so as to produce pellets having a weight of from 420 to 450 milligrams and an oblong shape, as shown in FIG. 2. For example, the pellet is sized with a length L of about 0.58 inches, a width W of 0.33 inches and a thickness t of about 0.19 to 0.20 inches.

By way of example, the dried mixture is received with a moisture content of from eight percent to ten percent. However, due to storage conditions and/or transportation conditions, the product may have a moisture content of from five percent to twelve percent. In any event, it has been found that the product may have a moisture content of up to 15% in order to produce pellets of acceptable consistency.

Referring to FIG. 3, in carrying out the pelletizing step of the process, the mixture is dosed via a hopper into cavities 10 of a rotating wheel 11 of a table press which are shaped to the contour of the pellets to be made. As shown in FIG. 3, each charge of the tobacco mixture is retained in a cavity 10 by a lower punch 12 which is controlled via a cam (not shown). Upon reaching a pressing station, a top punch 13 which is controlled by another cam (not shown) is pushed downwardly into the cavity 10 in order to press the tobacco mixture between the two punches 12, 13. The amount that the top punch 13 moves into the cavity 10 is such as to obtain a pellet with a weight in the range of 420 to 450 milligrams and with a height of 0.19 to 0.20 inches. In the event that the pressed pellets do not have sufficient weight, then more of the tobacco mixture is added to a cavity 10 by lowering of the lower punch 12.

After the tobacco mixture has been charged into a cavity 10, a suitable sweeper (not shown) is provided to clear excess mixture from the upper end of the cavity 10 and the adjacent regions of the rotating wheel 11.

The tablet press which is utilized is of known construction, for example a Kolton-216, Rotary Tablet Press manufactured by Vector Corporation of Grand Rapids, Iowa. Of course, any similar type of machines can be used.

The pellets 14 (see FIG. 2) which are produced may be coated with a suitable coating, for example in a coating pan, where such is desired.

Of note, the flavorant may be added to the tobacco mixture during processing as described above or may be added to a pellet by a coating operation. For example, should a wintergreen-flavored pellet be desired, a powdered wintergreen flavor can be added into the dried mixture immediately prior to pelletizing.

The pellets which are obtained can be packaged in suitable containers for shipment and/or sale. In this regard, the pellets are sized not only to be conveniently handled by a user and placed in the mouth but also to be packed. Further, the pellets are sized so as to be readily used without introducing great bulk into the user's mouth. At the same time, the pellets are sufficiently sized to give the user the desired taste and flavor of a conventional smokeless tobacco.

The invention thus provides a relatively simple process of producing tobacco pellets. Further, the use of shredded (cut) tobacco for pellets will be clean and neat and will require less expectoration while still giving the smokeless consumer tobacco satisfaction. In this regard, a cut or shredded product will not melt and float in the consumer's mouth and can be easily cleaned out or removed.

What is claimed is:

1. A process of making smokeless tobacco pellets, said process comprising the steps of forming a blend of dark-fired and one-sucker tobacco, and a cased cigar type tobacco;

cutting said blend to obtain a shredded product sized to pass through a No. 20 Tyler screen;

adding a binder to the sized shredded product;

adding water to the sized granular product to obtain a mixture of tobacco, binder and water;

heating the mixture to a temperature sufficient to uniformly disperse the binder through the mixture;

thereafter drying the mixture to a moisture content of from 8% to 10% water by weight; and pelletizing the dried mixture into individual discrete pellets.

2. A process as set forth in claim 1 wherein the pellets have a weight of from 420 to 450 milligrams.

3. A process as set forth in claim 1 which further comprises the step of adding a flavorant to the size shredded product prior to said heating step.

4. A process as set forth in claim 1 which further comprises the step of adding a flavorant to the pellets.

5. A process as set forth in claim 1 which further comprises the step of adjusting the moisture content of the mixture prior to pelleting of up to 15% water by weight.

6. A process as set forth in claim 1 wherein water is added to the shredded product to obtain a mixture of from 75% to 85% tobacco by weight, of from 1% to 4% binder by weight and the remainder water.

7. A process as set forth in claim 1 wherein said blend is formed of about 25% by weight of the cased cigar type tobacco and about 75% by weight of the dark-fired and one-sucker tobaccos in a ratio of about 90% dark-fired tobacco and 10% one-sucker tobacco.

8. A process as set forth in claim 1 wherein the dark-fired and one-sucker tobaccos are completely fermented.

9. A process as set forth in claim 1 wherein said blend is cut to obtain sixty cuts per inch.

10. A process of making tobacco pellets comprising forming a blend of tobaccos consisting of about 75% by weight of dark-fired tobacco and one-sucker tobacco and 25% by weight of cased cigar type tobaccos;

cutting said blend to obtain a shredded product sized at sixty cuts per inch;

adding a salt to said shredded product in an amount between 1% and 4% by weight;

adding one of a potassium carbonate and a sodium carbonate to said shredded product in an amount sufficient to obtain a neutral pH value;

adding a binder to said shredded product in an amount sufficient for binding of said tobaccos;

adding water to the shredded product to obtain a mixture consisting by weight of 75% to 85% tobacco; 1% to 4% salt; 1% to 4% carbonate; 1% to 4% binder and the remainder water;

heating and blending the mixture at a temperature of 140° F.;

drying the heated mixture to a moisture content of from 8% to 10% water by weight; and forming the dried mixture into discrete pellets of a weight of between 420 to 450 milligrams.

11. A process as set forth in claim 10 wherein the binder is licorice.

* * * * *